United States Patent [19]

Fischer

[11] 4,387,647

[45] Jun. 14, 1983

[54] OFFSET PRINTING MACHINE INKING SYSTEM WITH SELECTIVELY ENGAGEABLE BYPASS ROLLERS

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 345,227

[22] Filed: Feb. 3, 1982

Related U.S. Application Data

[63] Continuation-in-part of Ser. No. 186,532, Sep. 12, 1980, abandoned.

[30] Foreign Application Priority Data

Oct. 23, 1979 [DE] Fed. Rep. of Germany ..... 2942750

[51] Int. Cl.[3] ..... B41F 31/30

[52] U.S. Cl. ..... 101/350; 101/352

[58] Field of Search ..... 101/147, 148, 349–352, 101/363, 364, 340, 341, 344, 345, 347, 355, 356, 357, 360, 361, 204, 205, 206, 207, 208, 210, 342, 343, 346, 348, 353, 354, 358, 359; 118/262, 258

[56] References Cited

U.S. PATENT DOCUMENTS 3,150,589 9/1964 Senogles ..... 101/350

FOREIGN PATENT DOCUMENTS 1904531 11/1964 Fed. Rep. of Germany .
2012232 2/1973 Fed. Rep. of Germany .
2323025 8/1978 Fed. Rep. of Germany .
2724746 12/1978 Fed. Rep. of Germany ..... 101/349
2902047 7/1979 Fed. Rep. of Germany ..... 101/349

*Primary Examiner*—J. Reed Fisher
*Attorney, Agent, or Firm*—Frishauf, Holtz, Goodman & Woodward

[57] ABSTRACT

To provide, selectively, a high degree of ink and damping liquid to substrates of high absorbency, such as newsprint or a smaller amount of ink and little or no damping liquid when printing on calendared paper metal foil or other non-absorbent surfaces, the ink roller train, applying ink to a forme roller (2) in engagement with the plate cylinder, has a second or additional ink roller train in parallel thereto having an ink input roller (8*a*, 12), selectively, in engagement or out of engagement with an ink transfer roller (5, 6, 7) of the first ink roller train, and an ink output roller (8*e*, 13) in engagement with the forme roller. The additional ink roller train is a unit having a plurality of mutually surface engaged rollers, driven merely by their surface engagement or roller elements such as centerless floating cylinders or balls within a cage. For substrates of high absorbency, both the normal ink roller train as well as the additional ink roller train are connected, in parallel to provide a maximum of ink to the forme roller and hence to the plate cylinder; for printing of non-absorbent surfaces, the input rollers (8*a*, 12) of the additional ink transfer roller train unit are lifted off engagement from the normal ink transfer rollers, so that the roller elements of the additional ink transfer roller train are merely carried along by engagement of the output roller with the forme roller, and provide a large surface for evaporation of damping liquid applied thereto to effectively remove damping liquid from the forme roller and hence from the plate cylinder.

12 Claims, 2 Drawing Figures

OFFSET PRINTING MACHINE INKING SYSTEM WITH SELECTIVELY ENGAGEABLE BYPASS ROLLERS

Figure 1:
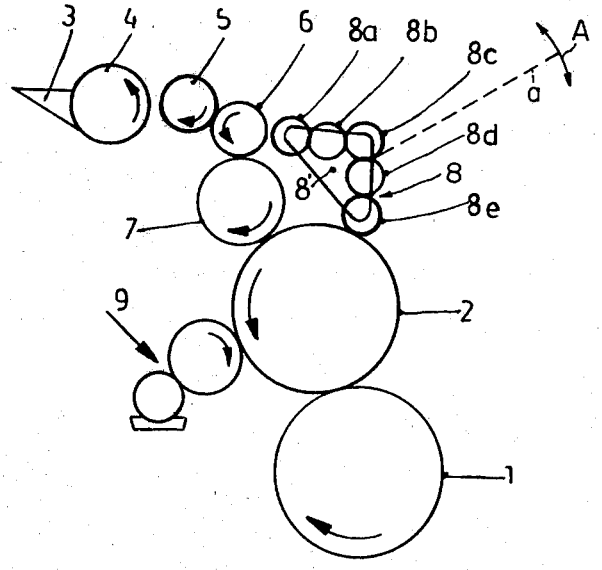

This application is a continuation-in-part of my earlier application 186,532, filed Sept. 12, 1980, and abandoned upon filing of this application.

The present invention relates to offset printing machines, and more particularly to the inking system therefor.

BACKGROUND AND PRIOR ART

Offset printing machines customarily have an inking system in which ink is supplied from an ink trough or ink supply furnishing element, which may include a doctor blade, or the like, through a plurality of rollers, some of which are axially oscillating, to the plate cylinder of the printing machine. Some rotary offset printing machines have a forme roller which is in engagement with the plate cylinder. The forme roller may have the same diameter as the plate cylinder or, in any event, is of larger diameter than the remaining ink transfer or oscillating or milling rollers within the ink roller train (see German Published Patent Application DE-AS No. 23 23 025). The ink film supplied by a forme roller of a diameter which is equal to or at least closely approaches that of the plate cylinder can be made to be essentially uniform, and the film thickness can be accurately adjusted. Such apparatus is eminently suitable for high-quality printing in which ghosts and streaking are effectively avoided. The mutual engagement surfaces between the plate cylinder and the forme roller, and hence the engaging run-off of the two cylinders against each other, is 1:1. This system, however, has the difficulty that the damping fluid, typically water, which is supplied to the plate cylinder, for example by the forme roller, cannot be readily removed, so that water spots or pits may result in the final print-out.

It has previously been proposed to prevent penetration of damping liquid into the ink train by applying an air blast to a roller within the ink train so that any damping liquid which might be transferred into the ink furnishing system is evaporated—see German Utility Model 1 904 531. This arrangement is, essentially, a drying system, and utilizes an axially oscillating milling roller in the ink train which is subjected to the air blast.

It has also been proposed to supply ink to the plate cylinder by using two parallel ink trains—see, for example, German Published Patent Application DE-AS No. 20 12 232. The two ink trains are in continuous rolling engagement. No provision is made for removal of excess damping liquid which may be carried along by the plate cylinder.

Current rotary offset printing presses must have a high degree of versatility, that is, the printing machine itself should be so constructed that it is capable of printing on various types of substrates. Due to the different absorbency of ink and wetting liquid of paper, different requirements are placed on the printing system when, for example, printing is to be effected on newsprint or on highly calendared paper, or, in an extreme case, on metal foil which is not absorbent at all.

The Invention

It is an object to provide an inking system in which the ink-damping liquid balance can be accurately matched to the substrate, so that damping liquid is positively removed when printing on a non-absorbent substrate, but permit supply of additional ink if printing is to be effected on substrates with a high degree of absorbency, for example newsprint, for both ink and damping liquids.

Briefly, the ink train has a forme roller in engagement with the plate cylinder. Besides the standard ink transfer roller train, which includes at least one ink milling roller, an additionally ink transfer roller train is provided which has the output roller thereof in continuous surface engagement, that is, in ink transferring relation to the plate cylinder, preferably via the forme roller; its input roller, however, is selectively engageable with one of the ink transfer rollers of the standard ink transfer roller train, or removable therefrom.

When engaged with the ink transfer roller train, the additional ink roller provides for transport of additional ink, while permitting, due to the presence of a large number of rollers, evaporation of damping liquid picked up from the plate cylinder; when removed therefrom, the rollers of the additional roller train being continuously driven by engagement of the output roller with the form roller, for example, provide a rotating idling surface which will pick up both ink and excess damping fluid from the plate cylinder—or the forme rollers, respectively—to provide for a large evaporation surface.

The additional or parallel or shunt ink transport train preferably can operate as an additional transport path selectively engageable, as a unit, for ink which is parallel to the standard or normally applied ink transfer train. If necessary, then, the second or additional or parallel train permits application of additional ink so that the ink film on the forme roller or the plate cylinder, respectively, will have the requisite thickness and uniformity. This dual or parallel path is particularly suitable when the material to be printed is highly absorbent paper, such as newsprint or the like.

If it is desired to print on substrates which are not absorbent, for example highly calendared paper, foil, or the like, then the ink input roller section of the second or additional ink roller train, as a unit, is removed from the roller of the ink furnishing train. Thus, only the final or output roller of the second ink transfer roller train will be in continuous driving engagement with the forme roller. In this mode of operation, the second or additional roller train will then function only as a drying or evaporating device for excess damping water which will be transferred or collect on the forme roller. This roller train, not leading anywhere but being then open at its "input", is driven only by mutual frictional engagement of the rollers themselves. Since a large number of such rollers can be provided, the surface area is large, providing for effective and efficient evaporation.

The second or additional roller train can utilize a series of rollers which have their end shaft journaled in suitable bearings, and are assembled in a frame as a set of rollers; alternatively, a cage structure can be provided in which roller elements are positioned, which may be in the form of balls, elongated cylinders, or the like, to operate in centerless, floating arrangement and providing a large overall surface for evaporation of damping liquid. The cage structure and the contents thereof can be ventilated, or supplied with drying air. The structure previously referred to of German Utility Model No 1 904 531 can be utilized only as a drying system and is not capable of transferring ink; since it has, continuously, an air blast applied to a circumference of one of the rollers. The structure of previously referred to German Published Application No. 20 12 232 does not permit selective engagement, and hence utilization of an additional or bypass roller set, selectively, as a parallel ink supply when more ink is desired, or as an evaporation system when essentially non-absorbent material is to be printed.

The system has the advantage that change-over between engaged and disengaged position of the additional ink transfer roller train can be carried out while the machine is in operation, and without any disassembly of rollers from the frame of the machine. Thus, printing can be effected, selectively, for example on substrates with high absorbency, such as newsprint, and on substrates with lower absorbency, for example magazine pages. Advertisements, to be reproduced in a daily publication, or on "glossy" paper, can thus be run, effectively, without interruption of machine set-up, thus substantially increasing the productivity of the machine.

DRAWINGS

Figure 2:
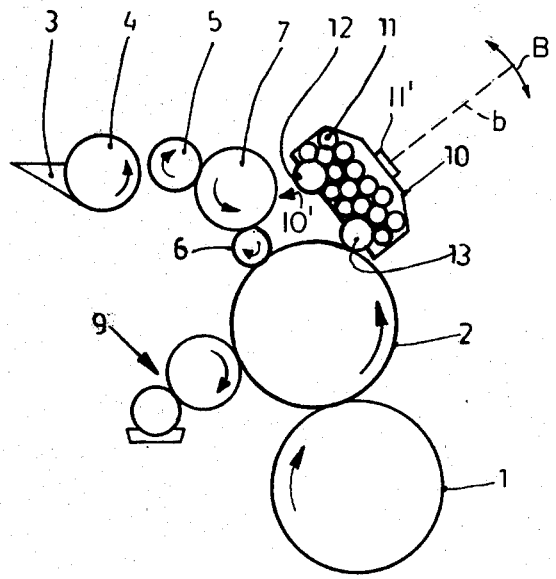

FIG. 1 is a highly schematic side view of a printing system using a shunt roller train; and FIG. 2 is a side view similar to FIG. 1, illustrating another embodiment.

A plate cylinder 1 (FIG. 1) of a rotary offset printing machine is in rolling contact with a rubber or blanket cylinder (not shown). Only that portion of the printing system which is necessary for an understanding of the invention is illustrated. Plate cylinder 1 is inked by a forme roller 2 which is positioned in parallel thereto and driven, as is customary. Forme roller 2 provides a film of ink and wetting liquid derived from a damping fountain 9.

Ink supplied to the forme roller 2 is derived from an ink trough 3 which applies ink to a duct roller 4 for transfer, in any known and suitable manner, to an ink distribution system which is formed by an ink train which has ink receiving roller 5, an axially oscillating milling roller 6 and an ink transfer roller 7. The duct roller 4 and the ink receiving roller 5 are driven, as is customary, with different circumferential speeds.

As illustrated in FIG. 1, the ink application roller 7 is bridged by a roller system unit 8, which has an ink receiving or ink input roller 8*b*, an ink output or applying roller 8*e*, and intermediate distribution rollers 8*b*, 8*c*, 8*d*. The number of rollers between the receiving roller 8*a* and the output roller 8*e* is selected to be as high as possible, within the space constraits of the printing machine. All the rollers 8*a* to 8*e* are driven by mutual frictional engagement, that is, they do not have any individual separate drive. The output roller 8*e* is in continuous surface engagement with the forme roller 2; in accordance with a feature of the invention, the roller assembly 8 can be positioned to place the first or input roller 8*a*, selectively, in engagement with roller 6, or out of engagement. FIG. 1 shows the position where roller 8*a* is out of engagement with roller 6.

Operation: If the machine is to print on a substrate which is highly absorbent, for example on newsprint, then the roller assembly or unit 8 is positioned so that the first or input roller 8*a* is in surface contact engagement with roller 6. This then provides a dual or shunt ink transport train, which is in parallel to the ink application roller 7. Thus, substrate material which requires increased ink supply will be effectively and sufficiently inked since ink is supplied to the formeroller 2 from the oscillating roller 6 both over the ink application roller 7 and over the roller train 8. The formeroller 2 thus will have the requisite thickness of ink, in homogeneous distribution. The film of ink on formeroller 2 will be of proper thickness for printing on paper of high absorbency.

Damping with a suitable damping liquid, for example water, is obtained by the damping fountain 9 which is positioned, in the direction of rotation of formeroller 2 beyond the inking system.

If the substrate on which printing is to be effected has low absorbency, for example highly calendared paper, metal foil or the like, so that the quantity of damping fluid applied from fountain system 9 is low, or even under conditions in which no damping fluid is needed, then the roller assembly or unit 8 is placed into the position shown in FIG. 1, that is, the input roller 8*a* is removed from surface engagement contact with the oscillating roller 6. The lower roller 8*e* remains in surface contact with the forme roller 2, however. Any excess water which will collect on the form roller 2 is thus applied to the roller 8*e* and transferred thereby into the engaged connecting roller train 8*d*, 8*c* . . . . The sequential placement of the rollers in the assembly 8 results in a high overall surface area, where the excess water can evaporate. Sufficient ink is supplied from the oscillating roller 6 to the application roller 7 and hence to the forme roller 2 and then to the plate cylinder.

Embodiment of FIG. 2: Rather than utilizing the roller assembly 8, the system of FIG. 2 utilizes a cage-like structure 10 in which a plurality of roller elements 11 are positioned. The cage structure 10 has an operating and support element 11′ and two rollers 12, 13 which project from the cage 10 for surface engagement of the ink train applying ink to the plate cylinder 1. Support element 11′ is reciprocatable as shown by arrow B. The roller elements 11 consist of a plurality of superpositioned balls, rollers, or other cylindrical elements, having surfaces which accept ink. The roller elements 11 within the cage 10 are in mutual surface engagement and are carried along by surface frictional forces. No separate drive to the roller elements 11 is necessary. The side walls of the cage 10 insure that sufficient lateral guidance of the roller elements is provided; the side walls may, for example, also include guide tracks to provide for at least some longitudinal orientation of the roller elements 11 if they are cylindrical elements extending transversely across the forme roller 2, for example. Yet, the centers of the roller elements 11 are not fixed, but are permitted to float or are operated completely centerless. Elimination of bearings for the roller elements 11 results in an inexpensive, yet highly efficient structure.

Rollers 12, 13 extend beyond the bottom of the cage 10 and provide frictional drive for the roller elements 11 therein. Their diameter is larger than the diameter of the roller elements 11. The output roller 13, similar to the output roller 8*e* of FIG. 1, is in continuous surface engagement with the forme roller 2. The input roller 12, however, can be placed in engagement with another roller of the ink train by moving the cage in the direction of arrow 10′. As shown in FIG. 2, roller 12 can be engaged with the application roller 7 which, in contrast to the embodiment illustrated in FIG. 1, is placed in engagement with the ink transfer roller 5, with the axially oscillating roller 6 being placed between roller 7 and forme roller 2.

The present invention is particularly applicable for use in printing machines in which the substrate can have widely different characteristics. It is especially important if it is desired to print in metallic or metallized papers or foils which, practically, have no absorbency of damping liquid at all. When printing on metal foils or on other substrates which will not absorb any damping liquid, the arrangement shown in FIGS. 1 and 2, with the input roller of the parallel roller train being lifted off the ink train is particularly suitable, since excess damping liquid or any moisture can be removed from the forme roller and evaporated by the idling rollers 8*a*–8*d* (FIG. 1) or by the roller element 11 (FIG. 2), respectively. Disconnecting the input of the roller system 8 or of the cage 10 from ink supply thereto by the inking system is particularly desirable under such operating conditions.

The system is particularly suitable for use in inking systems having forme rollers 2 which are of the same or at least approximately the same diameter as the plate cylinder 1. The system is, however, also applicable to other types of printing systems in which the ink application rollers in contact with the plate cylinder are of different, usually smaller and possibly substantially smaller diameter.

Various changes and modifications may be made within the scope of the inventive concept.

The mechanical arrangement of lifting the ink roller assembly 8 or cage 10, respectively, on and off engagement with the ink transferring cylinders which supply ink from the ink furnishing system 3, 4 can be of any suitable and desired construction, for example a lever, eccenter, or simple mechanical tilting or tipping arrangement, moving, as shown schematically by arrow A. No particular application pressure of the rollers of the system 8 or the rollers and the rolling elements within the cage 10 is needed, the respective rollers riding on the forme roller 2 and, if engaged, on the respective roller of the ink supply train by their own weight, and being driven by surface friction engagement.

The additional roller train, thus, formed by rollers 8*a*–8*e*, is engageable or disengageable as a unit by sliding the frame 8', retaining the rollers 8*a*, 8*b*, 8*c*, 8*d*, 8*e*, to while keeping the roller 8*e* in engagement with the forme roller 2. This sliding movement can readily be carried out be sliding the frame 8', with all the rollers thereon, about the axis of rotation of the forme roller 2. This movement can be carried out while the plate cylinder 1 is moving, that is, engagement and disengagement of the additional roller train unit 8 can be carried out in operation. No disassembly of any one of the rollers from their frame 8' is required. In the embodiment of FIG. 2, the cage 10 can be tipped about the center of rotation of the output roller 13 into the position shown in FIG. 2, or rocked forwardly - with respect to FIG. 2—in the direction of the arrow 10' to place the rollers 12, 11, 13 in parallel with the roller trains 7, 6, 2. Any suitable mechanism to move the frame 8' or the cage 10 can be used, for example a handle, a screw engagement, or the like, suitably engaging on the retaining structure 8' or the cage 10 of the individual roller elements. Movement of the roller unit 8 (FIG. 1) is schematically indicated by the arrow A, the operating means being schematically indicated by the broken line a to the arrow A; movement of the cage 10 of FIG. 2 is schematically indicated by the arrow B, connection to a suitable movable element, in accordance with design requirements, being indicated by broken line b. Thus, engagement of the additional ink train with the standard ink train of the printing machine is carried out by sliding or tipping the holder structure 8', 10, respectively, so that either two rollers or only a single roller of the additional ink train roller unit or assembly will be in engagement with selected rollers of the ink train of the printing machine. This movement can be carried out without disassembly of any of the roller elements from the respective holding structures, such as the frame 8' or the cage 10. Upon change-over, the mode of ink/water transfer to the forme roller 2 will change. Thus, moving the input roller 8*a*, 12, respectively, out of engagement with the ink train does not merely remove a roller from engagement, for example for cleaning; the roller will still be running, since the output roller 8*a*, 13, respectively, will remain in contact with the forme roller 2, only the input roller 8*a*, 12, respectively, being lifted off engagement, and thus removing a parallel path. Consequently, the path of ink/damping fluid changes between either a parallel path in the ink train, or in a single path with a continuously rolling evaporating apparatus additionally being provided. By tilting the holder about the axis of rotation of the output roller, or by sliding the output roller 8*a*, 13 along the circumference of the forme roller 2, away from the engaging roller 6 (FIG. 1) or 7 (FIG. 2) of the inking train, the change-over is accomplished simply and easily, and for example during continuous rotation of the plate cylinder 1 and the forme roller 2.

Various changes and modifications may be made, and features described in connection with one of the embodiments may be used with the other, within the scope of the inventive concept.

I claim:

1. An ink supply system for a rotary offset printing machine having a plate cylinder (1), means (3, 4) for furnishing printing ink;

an ink transfer roller train (2, 5, 6, 7) including a forme roller (2) in ink transferring engagement with the plate cylinder (1), an ink milling roller (6) and at least one ink transfer roller (5, 7) transferring ink between the ink furnishing means and the forme roller, and comprising an additional ink transfer roller train unit (8, 10) having a holder structure (8', 10);

an input roller (8*a*, 12);

an output roller (8*a*, 13);

and a plurality of intermediate rollers (8*b*–8*d*; 11) retained on the holder structure, the ink output roller (13) being in frictional engagement with and in ink transfer relation to the forme roller;

and means (a, b, 11') for moving the holder structure (8', 10) and with it the ink input roller (8*a*, 12) and the intermediate rollers, selectively, between a position in which the input roller is in or out of engagement with another one of the rollers (6, 7) of the ink transfer roller train, as a unit, the output roller (8*a*, 13) remaining in frictional engagement with the forme roller to provide, selectively, (a) a second path of ink from the ink furnishing means to the forme roller, or (b) a plurality of rollers in engagement only with the fluid from the forme roller.

2. Ink supply system according to claim 1, wherein (FIG. 1) the additional ink transfer roller train unit (10) comprises a set of rollers (8*a*–8*e*) being journaled in the holder structure at their respective axial ends, and in mutual surface engagement for frictional surface drive thereof.

3. Ink supply system according to claim 1, wherein (FIG. 2) the holder structure of the additional ink transfer roller train unit comprises a cage-like holder (10), a plurality of roller elements (11) having circular cross section and retained therein in centerless, floating position;

the output roller element (13) projecting from the cage-like holder (10) and being in surface engagement with the forme roller and driven thereby to impart rotation to the roller elements (11) within the interior of the cage-like holder (10).

4. Ink supply system according to claim 3, wherein the roller elements (11) within the cage-like holder (10) comprise a plurality of cylindrical rollers positioned next to each other and above each other within said cage-like holder.

5. Ink supply system according to claim 3, wherein the input and output rollers (12, 13) have a diameter which is larger than the diameters of the rollers elements (11) within said cage-like holder.

6. Ink supply system according to claim 3, wherein an even number of roller elements (11) is positioned between the input roller (12) and the output roller (13) in the cage-like holder (10) in a plane connecting the axes of rotation of said input and output rollers.

7. Ink supply system according to claim 1 or 2, wherein the input roller of the additional ink transfer roller train unit is positioned for selectively engageable or removable surface engagement with the ink milling roller (6) of said ink transfer roller train.

8. Ink supply system according to claim 3, wherein the input roller (12) of the additional ink transfer roller train unit is positioned for selectively engageable or removable position with respect to a non-oscillating ink transfer roller of said ink transfer roller train.

9. Ink supply system according to claim 3, wherein said cage-like holder (10) is formed with ventilating openings to provide for evaporation of damping liquid transferred to the roller elements (11) by engagement of the output roller (13) with the forme roller.

10. Ink supply system according to claim 1, 2 or 3, wherein the printing machine is a metallized paper or foil printing machine.

11. Ink supply system according to claim 1, wherein said means for moving the holder structure comprises moving the holder structure privotally about the center of rotation of the output roller (8*e*, 13).

12. Ink supply system according to claim 1, wherein said means for moving the holder structure comprises moving the holder structure in a curved sliding movement about the circumference of the forme roller (2).

* * * * *